US011043345B2

(12) United States Patent
Nagai et al.

(10) Patent No.: US 11,043,345 B2
(45) Date of Patent: Jun. 22, 2021

(54) LOAD DRIVING DEVICE AND LOAD DRIVING METHOD

(71) Applicant: FANUC CORPORATION, Yamanashi (JP)

(72) Inventors: Hirokazu Nagai, Yamanashi-ken (JP); Masaya Tateda, Yamanashi-ken (JP); Yasuyuki Matsumoto, Yamanashi-ken (JP)

(73) Assignee: FANUC CORPORATION, Yamanashi (JP)

( * ) Notice: Subject to any disclaimer, the term of this patent is extended or adjusted under 35 U.S.C. 154(b) by 332 days.

(21) Appl. No.: 16/267,449

(22) Filed: Feb. 5, 2019

(65) Prior Publication Data

US 2019/0244779 A1 Aug. 8, 2019

(30) Foreign Application Priority Data

Feb. 8, 2018 (JP) ..... JP2018-020593

(51) Int. Cl.
*H01H 47/02* (2006.01)
*H01H 47/00* (2006.01)
*H01H 11/04* (2006.01)

(52) U.S. Cl.
CPC ..... *H01H 47/02* (2013.01); *H01H 11/04* (2013.01); *H01H 47/001* (2013.01); *H01H 47/002* (2013.01)

(58) Field of Classification Search
CPC ..... H01H 47/02; H01H 47/001; H01H 47/002
See application file for complete search history.

(56) References Cited

U.S. PATENT DOCUMENTS

2012/0206851 A1* 8/2012 Weber ..... H01H 9/56 361/195
2014/0002092 A1* 1/2014 Kodama ..... G01R 31/3278 324/418
2014/0340808 A1* 11/2014 Kurita ..... E05F 15/71 361/170

FOREIGN PATENT DOCUMENTS

CN 102207539 A 10/2011
CN 102308227 A 1/2012
(Continued)

OTHER PUBLICATIONS

English Abstract and Machine Translation for Chinese Publication No. 102956399 A, published Mar. 6, 2013, 9 pgs.
(Continued)

*Primary Examiner* — Thienvu V Tran
*Assistant Examiner* — Bart Iliya
(74) *Attorney, Agent, or Firm* — Fredrikson & Byron, P.A.

(57) ABSTRACT

There are provided a driving control portion configured to output a closing command for bringing a contact to a closed state to a first driving portion, and also to output to the first driving portion an opening command for bringing the contact to an open state and the closing command in an alternate and repeated manner until the current runs through the contact; a number-of-retries obtaining portion configured to obtain, as a number of retries, the number of times that the driving control portion repeated the opening command and the closing command until the current runs through the contact after the driving control portion outputted the closing command to the first driving portion; and a usable period estimating portion configured to estimate a usable period from the present time of a first relay in accordance with the number of retries.

15 Claims, 6 Drawing Sheets

(56) References Cited

FOREIGN PATENT DOCUMENTS

| | | | |
|---|---|---|---|
| CN | 102956399 | A | 3/2013 |
| CN | 103443896 | A | 12/2013 |
| DE | 60207963 | T2 | 8/2006 |
| JP | 3180773 | A | 8/1991 |
| JP | 5266290 | A | 10/1993 |
| JP | 6243768 | A | 9/1994 |
| JP | 8129939 | A | 5/1996 |
| JP | 1073627 | A | 3/1998 |
| JP | 2006253010 | A | 9/2006 |
| JP | 2008224558 | A | 9/2008 |
| JP | 200925141 | A | 2/2009 |
| JP | 201270484 | A | 4/2012 |

OTHER PUBLICATIONS

English Abstract and Machine Translation for Japanese Publication No. H05-266290 A, published Oct. 15, 1993, 7 pgs.
English Abstract and Machine Translation for Chinese Publication No. 102308227 A, published Jan. 4, 2012, 65 pgs.
English Abstract and Machine Translation for Chinese Publication No. 102207539 A, published Oct. 5, 2011, 9 pgs.
English Abstract and Machine Translation for Chinese Publication No. 103443896 A, published Dec. 11, 2013, 18 pgs.
English Abstract and Machine Translation for Japanese Publication No. H06-243768 A, published Sep. 2, 1994, 5 pgs.
English Abstract and Machine Translation for Japanese Publication No. 03-180773 A, published Aug. 6, 1991, 5 pgs.
English Abstract and Machine Translation for Japanese Publication No. 7 07-073627 A, published Mar. 17, 1998, 7 pgs.
English Abstract and Machine Translation for Japanese Publication No. 2012-070484 A, published Apr. 5, 2012, 6 pgs.
English Abstract and Machine Translation for Japanese Publication No. 2006-253010 A, published Sep. 21, 2006, 16 pgs.
English Abstract and Machine Translation for Japanese Publication No. 2008-224558 A, published Sep. 25, 2008, 7 pgs.
English Abstract and Machine Translation for Japanese Publication No. 2009-025141 A, published Feb. 5, 2009, 12 pgs.
English Abstract and Machine Translation for Japanese Publication No. H08-129939 A, published May 21, 1996, 6 pgs.
English Abstract and Machine Translation for German Publication No. DE60207963T2, published Aug. 3, 2006, 19 pgs.

* cited by examiner

LOAD DRIVING DEVICE AND LOAD DRIVING METHOD

CROSS-REFERENCE TO RELATED APPLICATION

This application is based upon and claims the benefit of priority from Japanese Patent Application No. 2018-020593 filed on Feb. 8, 2018, the contents of which are incorporated herein by reference.

BACKGROUND OF THE INVENTION

Field of the Invention

The present invention relates to a load driving device having a relay and a load driving method.

Description of the Related Art

Japanese Laid-Open Patent Publication No. 2012-070484 discloses an on/off control device that obtains, as data for diagnosing lifetime of an opening/closing device that controls on and off of a load, an accumulated operating time, an accumulated conduction time, and an accumulated number of opening/closing operations of the opening/closing device.

SUMMARY OF THE INVENTION

The degree of degradation of relays (opening/closing devices) varies depending on the magnitude of the electric current conducted when the contact is in a closed state. Accordingly, the technique of Japanese Laid-Open Patent Publication No. 2012-070484 is unable to estimate the degree of degradation of a contact of a device whose conduction current differs in each operation, such as a dynamic brake circuit etc., and the accuracy of estimation of the time for which the relay will remain usable is low.

The present invention has been made to solve the problem above, and an object of the present invention is to provide a load driving device and a load driving method that can accurately estimate the degree of degradation of a relay at the time of measurement and the time during which the relay will remain usable after that time.

According to an aspect of the present invention, a load driving device having a relay includes a driving portion configured to drive the relay so that a contact of the relay enters a closed state or an open state; a driving control portion configured to output to the driving portion a closing command for bringing the contact to the closed state, and also to output to the driving portion alternately the closing command and an opening command for bringing the contact to the open state until the current runs through the contact; a number-of-retries obtaining portion configured to obtain, as a number of retries, a number of times that the driving control portion repeated the opening command and the closing command until the current runs through the contact after the driving control portion has outputted the closing command to the driving portion; and a usable period estimating portion configured to estimate a usable period of the relay in accordance with the number of retries.

According to another aspect of the present invention, in a load driving method by a load driving device having a relay, the load driving device includes a driving portion configured to drive the relay so that a contact of the relay enters a closed state or an open state, and the load driving method includes a driving control step of outputting to the driving portion a closing command for bringing the contact to the closed state, and also outputting to the driving portion alternately the closing command and an opening command for bringing the contact to the open state until the current runs through the contact; a number-of-retries obtaining step of obtaining, as a number of retries, a number of times that the opening command and the closing command were repeated until the current runs through the contact after the closing command has been outputted to the driving portion at the driving control step; and a usable period estimating step of estimating a usable period of the relay in accordance with the number of retries.

According to the present invention, it is possible to accurately estimate a time for which the relay will remain usable after the present time.

The above and other objects, features, and advantages of the present invention will become more apparent from the following description when taken in conjunction with the accompanying drawings, in which a preferred embodiment of the present invention is shown by way of illustrative example.

DESCRIPTION OF THE PREFERRED EMBODIMENTS

Embodiment

[Configuration of Motor Driving Device]

Figure 1:
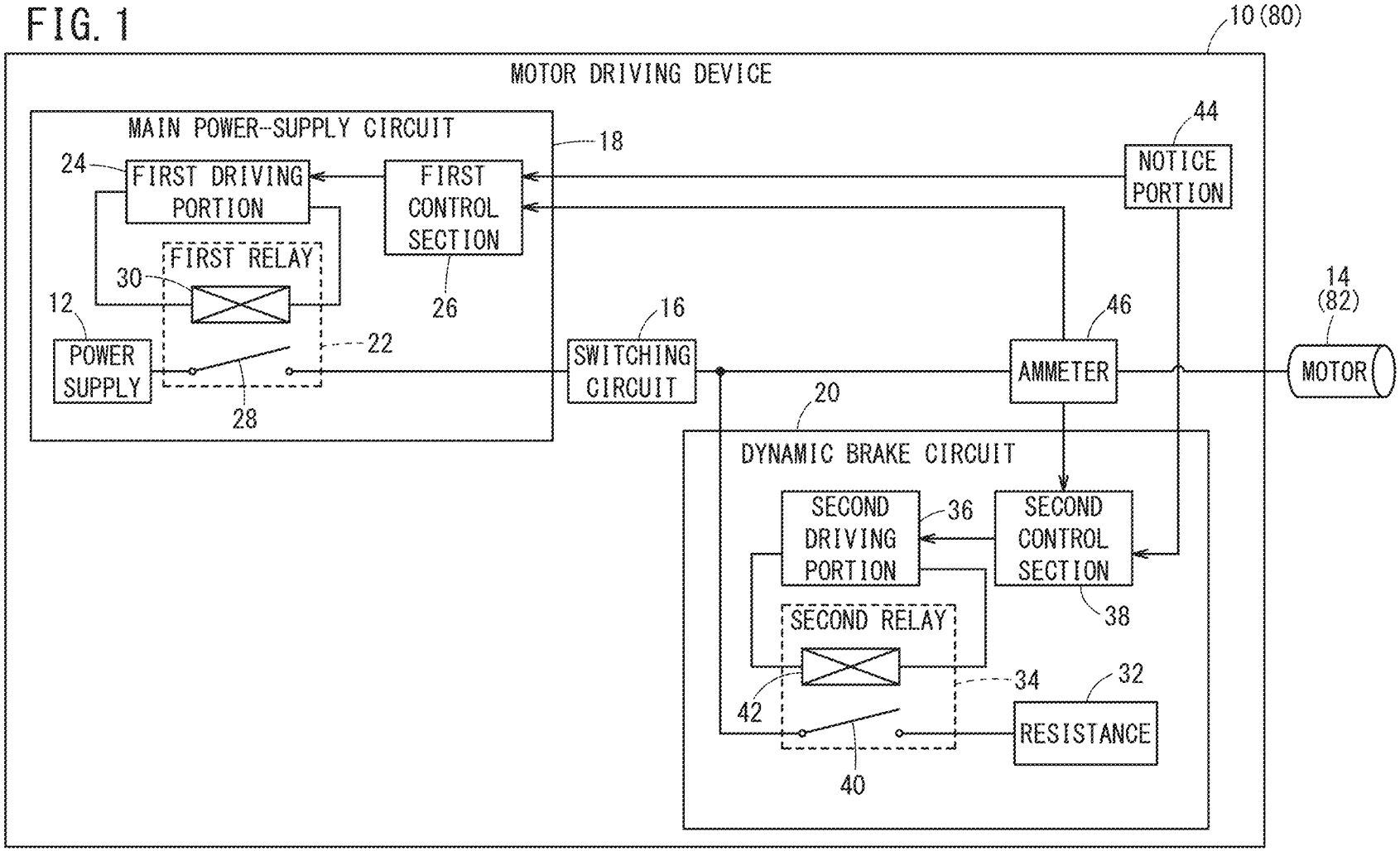
FIG. 1 is a block diagram showing the configuration of a motor driving device.

FIG. 1 is a block diagram showing the configuration of a motor driving device 10. The motor driving device 10 controls electric power supplied from a power supply 12 to a motor 14.

The motor driving device 10 includes a switching circuit 16, a main power-supply circuit 18, and a dynamic brake circuit 20. The switching circuit 16 is PWM-controlled by a motor control device (not shown) for controlling the motor 14, so as to control the power supplied to the motor 14. The motor driving device 10 constitutes a load driving device 80, and the motor 14 constitutes a load 82.

The main power-supply circuit 18 includes the power supply 12, a first relay 22, a first driving portion 24, and a first control section 26. The first relay 22 is provided between the power supply 12 and the switching circuit 16, and switches the state of the circuitry connecting the power supply 12 and the switching circuit 16 between a conducting state and a non-conducting state. The first relay 22 includes a contact 28 and a coil 30. The contact 28 establishes the conducting state between the power supply 12 and the switching circuit 16 when the contact 28 closes, and establishes the non-conducting state between the power supply 12 and the switching circuit 16 when the contact 28 opens. When a current is passed to the coil 30, the coil 30 goes in an excited state, and the magnetic force of the coil 30 closes the contact 28. On the other hand, when the current passed to the coil 30 is stopped, the coil 30 goes in a non-excited state and the contact 28 is opened by an urging force of an urging member (not shown).

The first driving portion 24 passes a current to the coil 30 so as to place the coil 30 in the excited state, and stops the current passed to the coil 30 so as to place the coil 30 in the non-excited state. The first driving portion 24 is controlled by the first control section 26 to control the passage of current to the coil 30.

When the coil 30 goes in the excited state and the contact 28 closes, then the power supply 12 and the switching circuit 16 are connected. The switching circuit 16 controls the power supplied to the motor 14. The motor 14 is thus driven.

The dynamic brake circuit 20 includes a resistance 32, a second relay 34, a second driving portion 36, and a second control section 38. The second relay 34 is provided between the motor 14 and the resistance 32 and switches the state of the circuitry connecting the motor 14 and the resistance 32 between a conducting state and a non-conducting state. The second relay 34 includes a contact 40 and a coil 42. The contact 40 establishes the conducting state between the motor 14 and the resistance 32 when the contact 40 closes, and establishes the non-conducting state between the motor 14 and the resistance 32 when the contact 40 opens. When a current is passed to the coil 42, the coil 42 goes in an excited state, and the magnetic force of the coil 42 closes the contact 40. On the other hand, when the current passed to the coil 42 is stopped, the coil 42 goes in a non-excited state and the contact 40 is opened by an urging force of an urging member (not shown).

The second driving portion 36 passes a current to the coil 42 so as to place the coil 42 in the excited state, and stops the current passed to the coil 42 so as to place the coil 42 in the non-excited state. The second driving portion 36 is controlled by the second control section 38 to control the passage of current to the coil 42.

When the coil 42 goes in the excited state and the contact 40 closes, then the motor 14 and the resistance 32 are connected. The switching circuit 16 controls the power supplied to the motor 14. The motor 14 is thus driven.

When the brakes are applied to the motor 14, the supply of power from the switching circuit 16 to the motor 14 is stopped, and the coil 42 is placed in the excited state so as to close the contact 40, thereby connecting the motor 14 and the resistance 32. Rotational resistance is thus caused to the motor 14 and a braking force is applied to the motor 14.

A notice portion 44 gives notice to an operator by displaying an image, letters, etc. on a screen. The notice portion 44 may be configured to give notice to the operator by sound or voice. The notice portion 44 gives notice to the operator on the basis of a control by the first control section 26 and the second control section 38.

An ammeter 46 is provided between the switching circuit 16 and the motor 14. The ammeter 46 detects a conduction current flowing through the contact 28 of the first relay 22 and a conduction current flowing through the contact 40 of the second relay 34.

[Configuration of First Control Section]

Figure 2B:
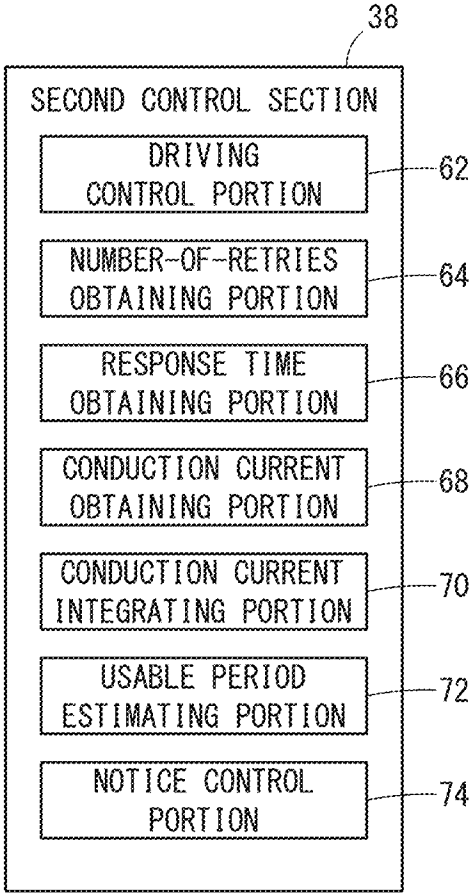
FIG. 2B is a block diagram showing a functional configuration of a second control section.
Figure 2A:
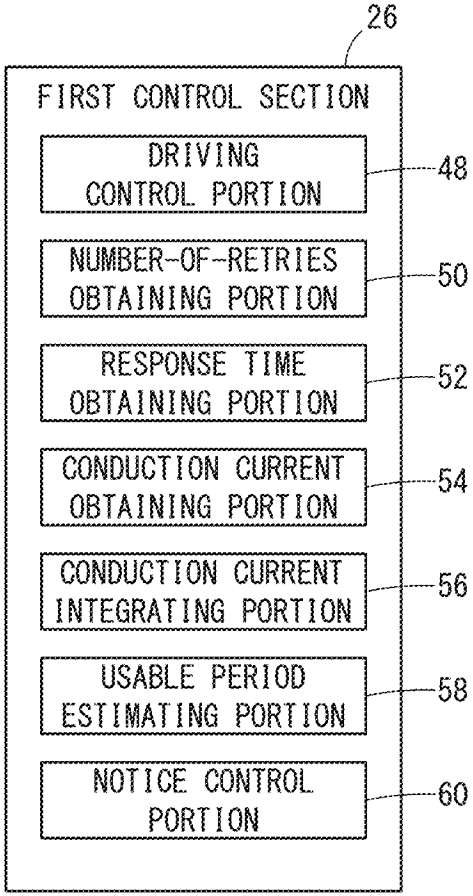
FIG. 2A is a block diagram showing a functional configuration of a first control section.

FIG. 2A is a block diagram showing a functional configuration of the first control section 26. The first control section 26 includes a driving control portion 48, a number-of-retries obtaining portion 50, a response time obtaining portion 52, a conduction current obtaining portion 54, a conduction current integrating portion 56, a usable period estimating portion 58, and a notice control portion 60.

When supplying power to the motor 14, the driving control portion 48 outputs a closing command to the first driving portion 24. Based on the closing command, the first driving portion 24 passes a current to the coil 30, so as to close the contact 28. When not supplying power to the motor 14, the driving control portion 48 outputs an opening command to the first driving portion 24. Based on the opening command, the first driving portion 24 stops the current to the coil 30, so as to open the contact 28. When the ammeter 46 does not detect conduction current (when the current does not run through the contact 28) even after a certain time period has elapsed after the output of the closing command to the first driving portion 24, the driving control portion 48 repeats alternate output of the closing command and opening command to the first driving portion 24 until conduction current is detected (until the current runs through the contact 28).

The number-of-retries obtaining portion 50 counts the number of times that the opening command and the closing command are repeated (hereinafter referred to as the number of retries) after the driving control portion 48 first outputted the closing command in order for the current to run through the contact 28, and obtains the number. The number of retries is counted by regarding a set of opening and closing commands as one time.

The response time obtaining portion 52 measures the time length from the instant the driving control portion 48 outputs the closing command to the first driving portion 24 to the instant the ammeter 46 detects conduction current (until the current runs through the contact 28) (hereinafter referred to as a response time). Since the response time is the time between the instant the driving control portion 48 outputs the closing command and the instant the current runs through the contact 28, the response time is not measured when the current does not run through the contact 28 even after the driving control portion 48 has outputted the closing command.

The conduction current obtaining portion 54 obtains the conduction current detected by the ammeter 46. The conduction current integrating portion 56 integrates the conduction currents that have flowed through the contact 28 from the start of use of the first relay 22 until the present time, and stores the integrated value (which will be hereinafter referred to as a conduction current integrated value).

The usable period estimating portion 58 estimates a period for which the first relay 22 will stay usable after the present time (hereinafter referred to as a usable period). The usable period is estimated based on the number of retries, the conduction current, the response time, and the conduction current integrated value. The process of estimating the usable period will be described in detail later.

The notice control portion 60 controls the notice portion 44 so as to display an image, letters, or generate sound to give notice of the estimated usable period to an operator when the conduction current integrated value has become equal to or more than a set current value, when the response time has become equal to or more than a set time, or when the number of retries has become equal to or more than a set number of times.

[Configuration of Second Control Section]

FIG. 2B is a block diagram showing a functional configuration of the second control section 38. The second control section 38 includes a driving control portion 62, a number-of-retries obtaining portion 64, a response time obtaining portion 66, a conduction current obtaining portion 68, a conduction current integrating portion 70, a usable period estimating portion 72, and a notice control portion 74.

When connecting the resistance 32 to the motor 14, the driving control portion 62 outputs a closing command to the second driving portion 36. Based on the closing command, the second driving portion 36 passes a current to the coil 42, so as to close the contact 40. When not connecting the resistance 32 to the motor 14, the driving control portion 62 outputs an opening command to the second driving portion 36. Based on the opening command, the second driving portion 36 stops the current to the coil 42, so as to open the contact 40. When the ammeter 46 does not detect conduction current (when the current does not run through the contact 40) even after a certain time period has elapsed after the output of the closing command to the second driving portion 36, the driving control portion 62 repeats alternate output of the closing command and opening command to the second driving portion 36 until conduction current is detected (until the current runs through the contact 40).

The number-of-retries obtaining portion 64 counts the number of times that the opening command and the closing command are repeated (hereinafter referred to as the number of retries) after the driving control portion 62 first outputted the closing command in order for the current to run through the contact 40, and obtains the number. The number of retries is counted by regarding a set of opening and closing commands as one time.

The response time obtaining portion 66 measures the response time from the instant the driving control portion 62 outputs the closing command to the second driving portion 36 to the instant the ammeter 46 detects conduction current (until the current runs through the contact 40). Since the response time is the time between the instant the driving control portion 62 outputs the closing command and the instant the current runs through the contact 40, the response time is not measured when the current does not run through the contact 40 even after the driving control portion 62 has outputted the closing command.

The conduction current obtaining portion 68 obtains the conduction current detected by the ammeter 46. The conduction current integrating portion 70 integrates the conduction currents that have flowed through the contact 40 from the start of use of the second relay 34 until the present time, and stores the integrated value (which will be hereinafter referred to as a conduction current integrated value).

The usable period estimating portion 72 estimates a period for which the second relay 34 will stay usable from the present time (hereinafter referred to as a usable period). The usable period is estimated based on the number of retries, the conduction current, the response time, and the conduction current integrated value. The process of estimating the usable period will be described in detail later.

The notice control portion 74 controls the notice portion 44 so as to display an image, letters, or to generate sound to give notice of the estimated usable period to the operator when the conduction current integrated value has become equal to or more than a set current value, when the response time has become equal to or more than a set time, or when the number of retries has become equal to or more than a set number of times.

[Usable Period Estimating Process]

Figure 3:
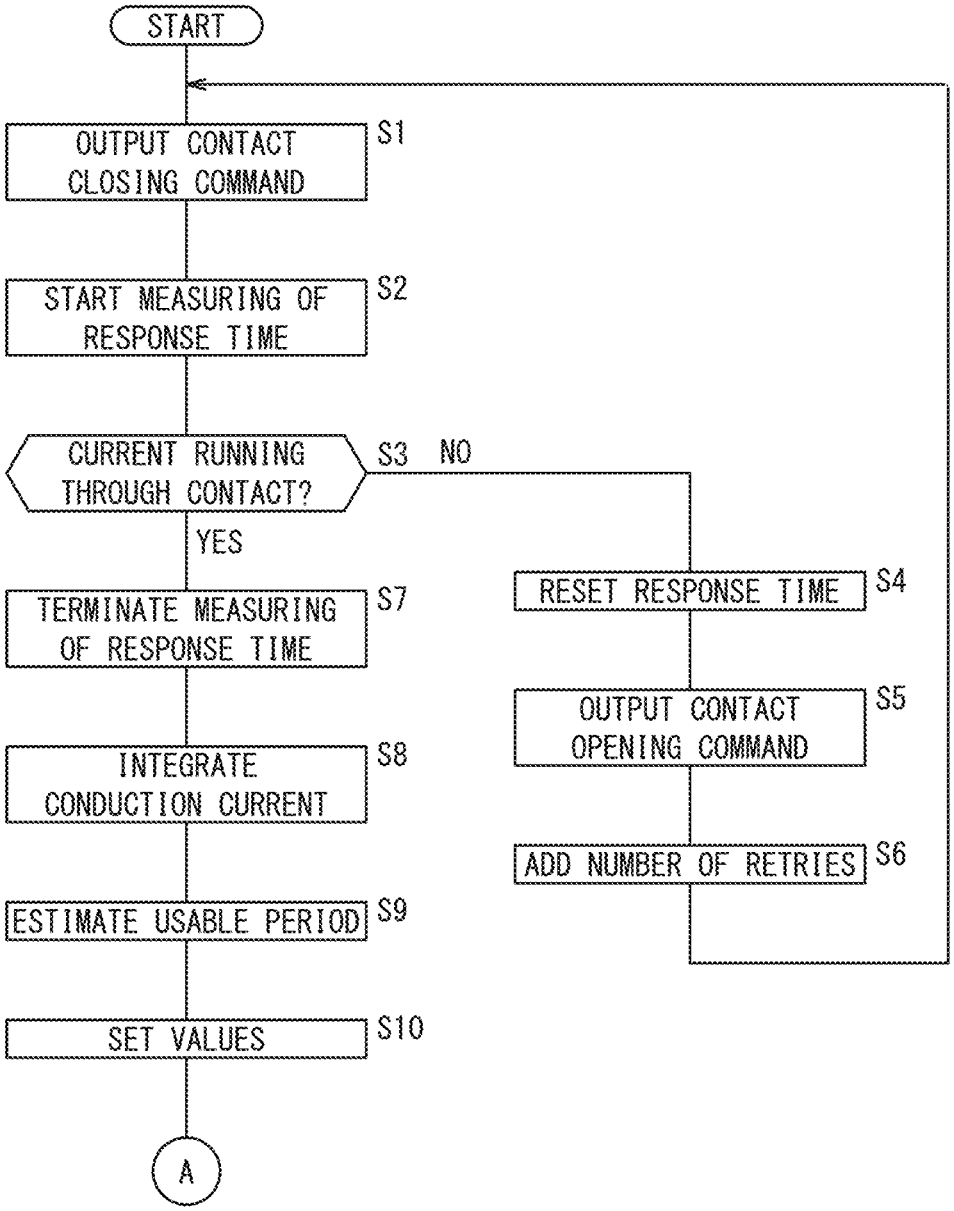
FIG. 3 is a flowchart showing a process of estimating a time for which a first relay and a second relay will remain usable, which is performed in the first control section and the second control section.
Figure 4:
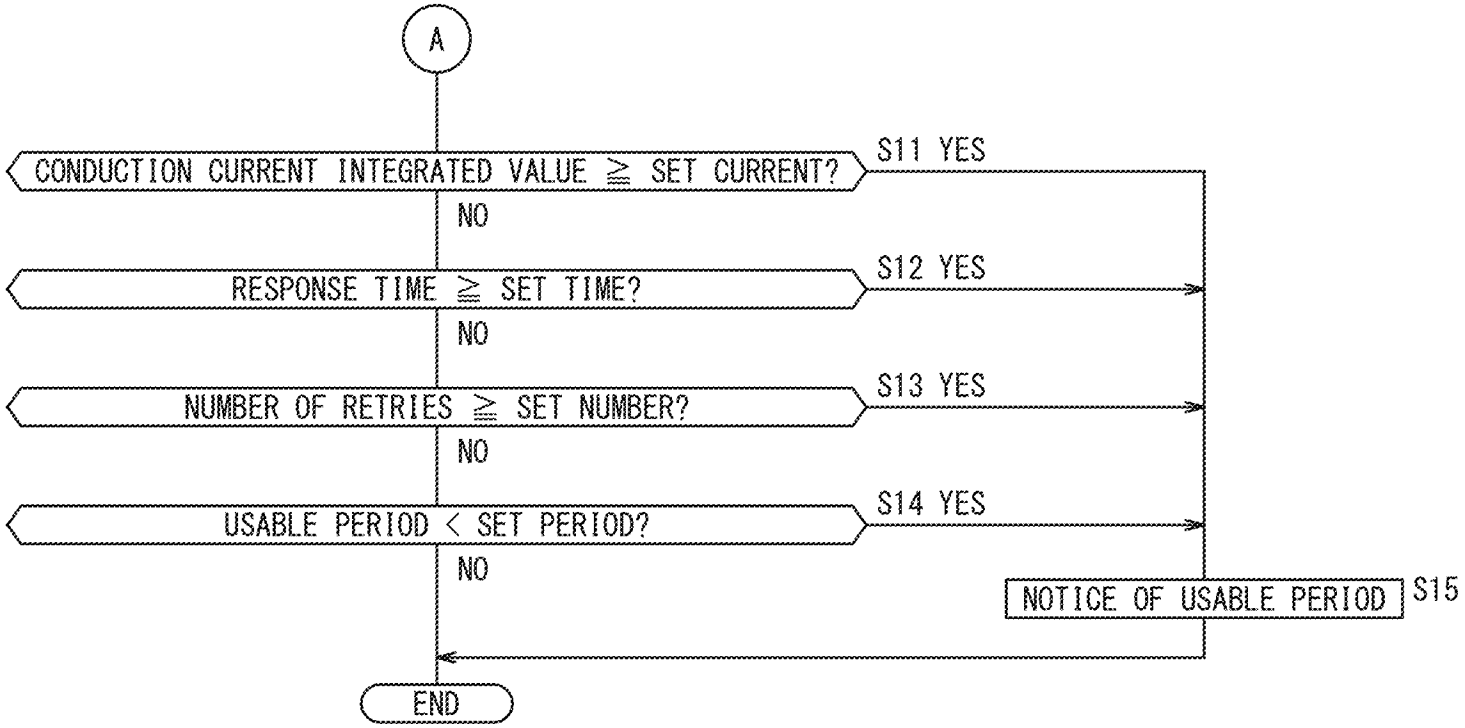
FIG. 4 is a flowchart showing the process of estimating the time for which the first relay and the second relay will remain usable, which is performed in the first control section and the second control section.

FIGS. 3 and 4 constitute a flowchart illustrating the flow of a usable period estimating process concerning the first relay 22 and the second relay 34 that is performed in the first control section 26 and the second control section 38. The usable period estimating process concerning the first relay 22 performed in the first control section 26 is substantially the same as the usable period estimating process concerning the second relay 34 performed in the second control section 38 except that the target of the usable period estimation differs.

At step S1, the driving control portion 48 (driving control portion 62) outputs the closing command to the first driving portion 24 (second driving portion 36) and the process proceeds to step S2. At step S2, the response time obtaining portion 52 (response time obtaining portion 66) starts measurement of the response time and the process proceeds to step S3.

At step S3, the driving control portion 48 (driving control portion 62) determines whether the current runs through the contact 28 (contact 40) before a certain time period passes after the driving control portion 48 (driving control portion 62) outputted the closing command to the first driving portion 24 (second driving portion 36). When the current runs through the contact 28 (contact 40), the process proceeds to step S7. When the current does not run through the contact 28 (contact 40), the process proceeds to step S4.

At step S4, the response time obtaining portion 52 (response time obtaining portion 66) resets the response time and the process proceeds to step S5. By resetting the response time at step S4, the response time is not measured if the current does not run through the contact 28 (contact 40) even after the certain time period has passed after the driving control portion 48 (driving control portion 62) outputted the closing command.

At step S5, the driving control portion 48 (driving control portion 62) outputs the opening command to the first driving portion 24 (second driving portion 36) and the process proceeds to step S6. At step S6, the number-of-retries obtaining portion 50 increments the previous value of the number of retries and the process returns to step S1.

When it is determined at step S3 that the current is running through the contact 28 (contact 40) before the certain time has elapsed after the closing command was outputted to the first driving portion 24 (second driving portion 36), the response time obtaining portion 52 (response time obtaining portion 66) terminates, at step S7, the measurement of the response time and the process proceeds to step S8.

At step S8, the conduction current integrating portion 56 (conduction current integrating portion 70) integrates the conduction current flowing through the contact 28 (contact 40) and the process proceeds to step S9. The conduction current integrated value is obtained by adding the time integral of the conduction current while the current runs through the contact 28 (contact 40) to the conduction current integrated value up to the time when the current runs through the contact 28 (contact 40) last time.

At step S9, the usable period estimating portion 58 (usable period estimating portion 72) estimates the usable period of the first relay 22 (second relay 34) and the process proceeds to step S10. The usable period is estimated to be shorter when the number of retries is larger, to be shorter when the conduction current is larger, to be shorter when the response time is longer, and to be shorter when the conduction current integrated value is larger.

At step S10, the notice control portion 60 (notice control portion 74) sets a set current, a set time, and a set number of times that are used in the following steps, and the process proceeds to step S11. As the conduction current becomes larger, the set current is set to be smaller, the set time is set to be shorter, and the set number of times is set to be smaller. The set current, the set time, and the set number of times that are set in the notice control portion 60, and the set current, the set time, and the set number of times that are set in the notice control portion 74, may be equal to each other, or may be different from each other.

At step S11, the usable period estimating portion 58 (usable period estimating portion 72) determines whether or not the conduction current integrated value is equal to or more than the set current. When the conduction current integrated value is equal to or more than the set current, the process proceeds to step S15. When the conduction current integrated value is less than the set current, the process proceeds to step S12.

At step S12, the usable period estimating portion 58 (usable period estimating portion 72) determines whether or not the response time is equal to or more than the set time. When the response time is equal to or more than the set time, the process proceeds to step S15. When the response time is less than the set time, the process proceeds to step S13.

At step S13, the usable period estimating portion 58 (usable period estimating portion 72) determines whether or not the number of retries is equal to or more than the set number of times. When the number of retries is equal to or more than the set number of times, the process proceeds to step S15. When the number of retries is less than the set number of times, the process proceeds to step S14.

At step S14, the usable period estimating portion 58 (usable period estimating portion 72) determines whether the usable period is less than a predetermined set period. When the usable period is less than the set period, the process proceeds to step S15. When the usable period is equal to or more than the set period, the process is terminated. The set period used to make the determination in the usable period estimating portion 58 and the set period used to make the determination in the usable period estimating portion 72 may be equal to each other or may be different from each other.

At step S15, the usable period estimating portion 58 (usable period estimating portion 72) estimates the usable period of the first relay 22 (second relay 34), and the notice control portion 60 (notice control portion 74) controls the notice portion 44 so as to give notice about the estimated usable period to the operator, and the process is terminated. The process of estimating the usable period of the first relay 22 (second relay 34) performed by the usable period estimating portion 58 (usable period estimating portion 72) will next be described in detail.

[Estimation of Usable Period]

Figure 5:
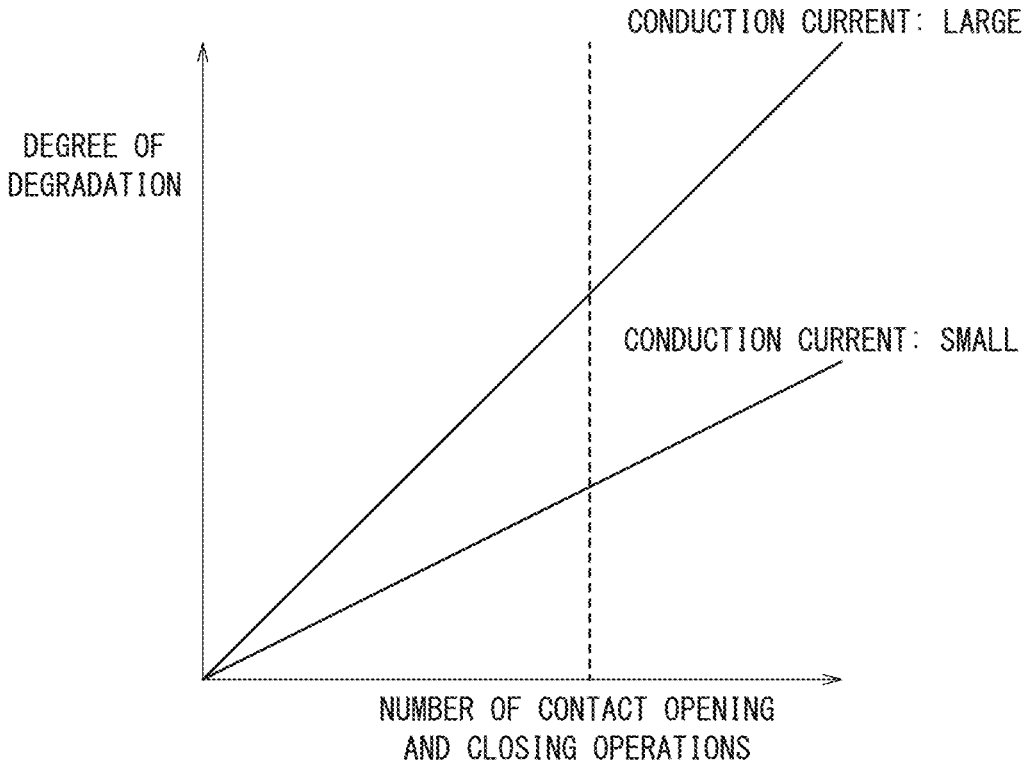
FIG. 5 is graph schematically showing the degree of degradation of a contact of the first relay and the second relay with respect to the number of times that the contact is opened and closed.

FIG. 5 is a graph schematically showing the degree of degradation of the contact 28 (contact 40) with respect to the number of opening and closing operations of the contact 28 (contact 40) of the first relay 22 (second relay 34). Every time the contact 28 (contact 40) is opened/closed, the contact surface of the contact 28 (contact 40) wears and the contact 28 (contact 40) suffers corrosion etc., and thus the degradation of the contact 28 (contact 40) progresses. The degradation of the contact 28 (contact 40) progresses faster as the conduction current flowing through the contact 28 (contact 40) is larger. Accordingly, as shown in FIG. 5, even when the number of opening and closing operations of the contact 28 (contact 40) is the same, the degree of degradation of the contact 28 (contact 40) is higher as the conduction current is larger. That is to say, the degree of degradation of the contact 28 (contact 40) cannot be estimated correctly only from the number of opening and closing operations of the contact 28 (contact 40).

Accordingly, the degree of degradation of the contact 28 (contact 40) is estimated on the basis of the number of retries. The contact 28 (contact 40) is more likely to cause contact failure as the degree of degradation of the contact 28 (contact 40) becomes higher, and then the number of retries tends to become larger. In this way, the degree of degradation of the contact 28 (contact 40) can be correctly estimated based on the number of retries.

Further, the degree of degradation of the contact 28 (contact 40) may be estimated in accordance with the response time in addition to the number of retries. As the degradation of the contact 28 (contact 40) progresses, opening/closing of the contact 28 (contact 40) takes more time due to corrosion of the contact 28 (contact 40). Using the response time in addition to the number of retries improves the accuracy of estimation of the degree of degradation of the contact 28 (contact 40).

Further, the degree of degradation of the contact 28 (contact 40) may be estimated in accordance with the conduction current integrated value in addition to the number of retries. As described above, the degree of degradation of the contact 28 (contact 40) becomes higher as the conduction current through the contact 28 (contact 40) becomes larger. Using the conduction current integrated value in addition to the number of retries improves the accuracy of estimation of the degree of degradation of the contact 28 (contact 40).

Figure 6:
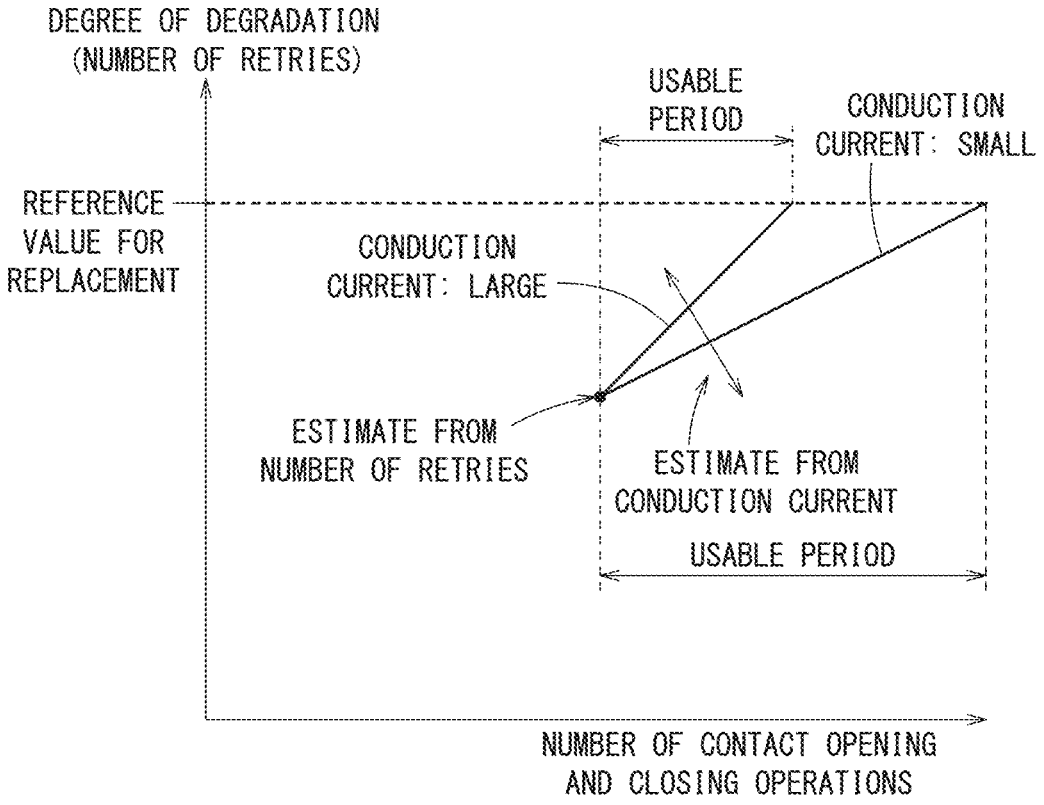
FIG. 6 is a time chart schematically showing the degree of degradation of the contact at the present time and conditions of progress of degradation of the contact depending on the magnitude of conduction current.

Further, the usable period of the first relay 22 (second relay 34) is estimated based on the estimated degree of degradation and the magnitude of the conduction current that is flowing at present through the contact 28 (contact 40). FIG. 6 is a time chart schematically showing a condition of the degree of degradation of the contact 28 (contact 40) at the present time and the progress of degradation of the contact 28 (contact 40) which depends on the magnitude of the conduction current. As mentioned above, the progress of degradation of the contact 28 (contact 40) is faster if the conduction current flowing through the contact 28 (contact 40) is larger. Therefore, as shown in FIG. 6, even if the present degradation degree is the same, the degree of degradation of the contact 28 (contact 40) reaches a reference value for replacement of the first relay 22 (second relay 34) in a shorter period as the conduction current is larger; that is, the usable period of the first relay 22 (second relay 34) becomes shorter. The speed of degradation of the contact 28 (contact 40) in the future can be estimated from the magnitude of the conduction current flowing through the contact 28 (contact 40) at present. The accuracy of estimation of the usable period of the first relay 22 (second relay 34) can thus be improved.

The usable period of the first relay 22 (second relay 34) can be estimated also by using a predetermined speed as the speed of degradation. Further, the usable period of the first relay 22 (second relay 34) can be estimated also by using a speed of degradation in the past. Still further, the usable period of the first relay 22 (second relay 34) can also be estimated by using an estimated degradation speed that has been obtained by estimating a future degradation speed of the contact 28 (contact 40) by using, for example, an average value of the magnitude of conduction current that has flowed through the contact 28 (contact 40) in the past.

[Functions and Effects]

The degree of degradation of the first relay 22 and the second relay 34 varies also depending on the magnitude of conduction current flowing when the contact 28 or the contact 40 is in the closed state. Accordingly, the accuracy of the degree of degradation of the first relay 22 or the second relay 34 was low when it is estimated from, for example, the number of opening and closing operations of the contact 28 or the contact 40. Especially, for the dynamic brake circuit 20, the degree of degradation of the contact 40 could not be estimated because the conduction current through the contact 40 of the second relay 34 differs every time the second relay 34 operates.

In this embodiment, the usable period estimating portion 58 (usable period estimating portion 72) estimates the usable period of the first relay 22 (second relay 34) in accordance with the number of retries. The degree of degradation of the contact 28 (contact 40) can be highly accurately estimated on the basis of the number of retries, and using the estimated degree of degradation improves the accuracy of estimation of the usable period of the first relay 22 (second relay 34).

Further, in this embodiment, the usable period estimating portion 58 (usable period estimating portion 72) estimates the usable period of the first relay 22 (second relay 34) in accordance with the number of retries and the magnitude of the conduction current flowing through the contact 28 (contact 40) at present. A future degradation speed of the contact 28 (contact 40) can be highly accurately estimated based on the magnitude of the conduction current flowing through the contact 28 (contact 40) at present, and the accuracy of estimation of the usable period of the first relay 22 (second relay 34) can be improved.

Furthermore, in this embodiment, the usable period estimating portion 58 (usable period estimating portion 72) estimates the usable period of the first relay 22 (second relay 34) in accordance with at least one of the response time and the conduction current integrated value in addition to the number of retries. The degree of degradation of the contact 28 (contact 40) can be estimated also from the response time and the conduction current integrated value, and the degree of degradation of the contact 28 (contact 40) can be highly accurately estimated by using the response time and the conduction current integrated value in addition to the number of retries. Thus, by using the estimated degree of degradation, the accuracy of estimation of the usable period of the first relay 22 (second relay 34) can be improved.

Still further, in the embodiment, the notice portion 44 notifies the operator of the estimated usable period of the first relay 22 (second relay 34). It is thus possible to give notice such that the operator can recognize the usable period of the first relay 22 (second relay 34).

Further, in this embodiment, the notice portion 44 notifies the operator of the usable period of the first relay 22 (second relay 34) when the number of retries is equal to or more than a set number of times. When the number of retries is equal to or more than the set number of times, or when the response time is equal to or more than the set time, or when the conduction current integrated value is equal to or more than the set current, the degree of degradation of the first relay 22 (second relay 34) is high and the usable period of the first relay 22 (second relay 34) is short. Therefore, when the usable period of the first relay 22 (second relay 34) is long, no notice is given to the operator and the operator is not bothered by frequent notices. When the usable period of the first relay 22 (second relay 34) is short, notice is given to the operator so that the operator can recognize the usable period of the first relay 22 (second relay 34).

Furthermore, in the embodiment, the set number of times, the set time, and the set current, described above, are set in accordance with the magnitude of the conduction current flowing through the contact 28 (contact 40) at present. The usable period of the first relay 22 (second relay 34) becomes shorter as the magnitude of the conduction current flowing through the contact 28 (contact 40) at present becomes larger. Thus, the set number of times, the set time, and the set current can be set in accordance with the usable period of the first relay 22 (second relay 34), and hence it is possible to give notice so that the operator can recognize the usable period of the first relay 22 (second relay 34) when the usable period of the first relay 22 (second relay 34) has become short.

[Technical Ideas Obtained from Embodiment]

Technical ideas that can be grasped from the above-described embodiment will be described below.

A load driving device (80) having a relay (22, 34) includes: a driving portion (24, 36) configured to drive the relay (22, 34) so that a contact (28, 40) of the relay (22, 34) enters a closed state or an open state; a driving control portion (48, 62) configured to output to the driving portion (24, 36) a closing command for bringing the contact (28, 40) to the closed state, and also to output to the driving portion (24, 36) alternately the closing command and an opening command for bringing the contact (28, 40) to the open state until the current runs through the contact (28, 40); a number-of-retries obtaining portion (50, 64) configured to obtain, as a number of retries, the number of times that the driving control portion (48, 62) repeated the opening command and the closing command until the current runs through the contact (28, 40) after the driving control portion (48, 62) outputted the closing command to the driving portion (24, 36); and a usable period estimating portion (58, 72) configured to estimate a usable period of the relay (22, 34) in accordance with the number of retries. Thus, it is possible to estimate the degree of degradation of the contact (28, 40) of the relay (22, 34) and improve the accuracy of estimation of the usable period.

The above-described load driving device (80) may further include a conduction current obtaining portion (54, 68) configured to obtain a conduction current flowing through the contact (28, 40), and the usable period estimating portion (58, 72) may be configured to estimate the usable period in accordance with the number of retries and the conduction current. It is thus possible to improve the accuracy of estimation of the usable period of the relay (22, 34).

The above-described load driving device (80) may further include a notice portion (44) configured to notify an operator of the usable period. It is thus possible to give notice such that the operator can recognize the usable period of the relay (22, 34).

In the above-described load driving device (80), the notice portion (44) may be configured to notify the operator of the usable period when the number of retries is equal to or more than a set number of times. In this way, when the usable period of the relay (22, 34) is long, no notice is given to the operator so that the operator is not bothered by frequent notices. When the usable period of the relay (22, 34) is short, notice is given to the operator so that the operator can recognize the usable period of the relay (22, 34).

The above-described load driving device (80) may further include a conduction current obtaining portion (54, 68) configured to obtain a conduction current at the contact (28, 40), and the notice portion (44) may be configured to set the set number of times in accordance with the conduction current. It is thus possible to give notice to the operator so that the operator can recognize the usable period of the relay (22, 34) when the usable period of the relay (22, 34) has become short.

The above-described load driving device (80) may further include a response time obtaining portion (52, 66) configured to obtain a response time from when the driving control portion (48, 62) outputs the closing command to the driving portion (24, 36) to when the current runs through the contact (28, 40); a conduction current obtaining portion (54, 68) configured to obtain a conduction current flowing through the contact (28, 40); and a conduction current integrating portion (56, 70) configured to integrate the conduction current to calculate a conduction current integrated value, and the usable period estimating portion (58, 72) may be configured to estimate the usable period in accordance with at least one of the response time, the conduction current, and the conduction current integrated value in addition to the number of retries. It is thus possible to improve the accuracy of estimation of the usable period of the relay (22, 34).

The load driving device (80) may further include a notice portion (44) configured to notify an operator of the usable period. It is thus possible to give the operator notice such that the operator can recognize the usable period of the relay (22, 34).

In the above-described load driving device (80), the notice portion (44) may be configured to notify the operator of the usable period when the number of retries is equal to or more than a set number of times, or when the response time is equal to or more than a set time, or when the conduction current integrated value is equal to or more than a set current. In this way, when the usable period of the relay (22, 34) is long, no notice is given to the operator so that the operator is not bothered by frequent notices. When the usable period of the relay (22, 34) is short, notice is given to the operator so that the operator can recognize the usable period of the relay (22, 34).

In the above-described load driving device (80), the notice portion (44) may be configured to set the set number of times, the set time, or the set current in accordance with the conduction current. It is thus possible to give the operator notice such that the operator can recognize the usable period of the relay (22, 34) when the usable period of the relay (22, 34) has become short.

In the above-described load driving device (80), the notice portion (44) may be configured to notify the operator of the usable period when the usable period is less than a set period. It is thus possible to give the operator notice such that the operator can recognize the usable period of the relay (22, 34) when the usable period of the relay (22, 34) has become short.

In a load driving method for a load driving device (80) having a relay (22, 34), the load driving device (80) includes a driving portion (24, 36) configured to drive the relay (22, 34) so that a contact (28, 40) of the relay (22, 34) enters a closed state or an open state, and the load driving method includes: a driving control step of outputting a closing command for bringing the contact (28, 40) to the closed state to the driving portion (24, 36), and also outputting to the driving portion (24, 36) an opening command for bringing the contact (28, 40) to the open state and the closing command in an alternate and repeated manner until the current runs through the contact (28, 40); a number-of-retries obtaining step of obtaining, as a number of retries, the number of times that the opening command and the closing command were repeated until the current runs through the contact (28, 40) after the closing command has been outputted to the driving portion (24, 36) at the driving control step; and a usable period estimating step of estimating a usable period of the relay (22, 34) in accordance with the number of retries. Thus, it is possible to improve the accuracy of estimation of the usable period of the relay (22, 34).

The above-described load driving method may further include a conduction current obtaining step of obtaining a conduction current flowing through the contact (28, 40), and the usable period estimating step may estimate the usable period in accordance with the number of retries and the conduction current. It is thus possible to improve the accuracy of estimation of the usable period of the relay (22, 34).

In the above-described load driving method, the load driving device (80) may further include a notice portion (44) configured to give an operator notice, and the load driving method may further include a notice control step of controlling the notice portion (44) to notify the operator of the usable period. It is thus possible to give notice such that the operator can recognize the usable period of the relay (22, 34).

In the above-described load driving method, the notice control step may control the notice portion (44) to notify the operator of the usable period when the number of retries is equal to or more than a set number of times. In this way, when the usable period of the relay (22, 34) is long, no notice is given to the operator so that the operator is not bothered by frequent notices. When the usable period of the relay (22, 34) is short, notice is given to the operator so that the operator can recognize the usable period of the relay (22, 34).

The above-described load driving method may further include a conduction current obtaining step of obtaining a conduction current of the contact (28, 40), and the notice control step may set the set number of times in accordance with the conduction current. It is thus possible to give notice to the operator so that the operator can recognize the usable period of the relay (22, 34) when the usable period of the relay (22, 34) has become short.

The present invention is not limited to the above-described embodiment, and various modifications can be made without departing from the gist of the present invention.

What is claimed is:

1. A load driving device having a relay, comprising:

a driving portion configured to drive the relay so that a contact of the relay enters a closed state or an open state;

a driving control portion configured to output to the driving portion a closing command for bringing the contact to the closed state, and also to output to the driving portion alternately the closing command and an opening command for bringing the contact to the open state until current runs through the contact;

a number-of-retries obtaining portion configured to obtain, as a number of retries, a number of times that the driving control portion repeated the opening command and the closing command until the current runs through the contact after the driving control portion outputted the closing command to the driving portion; and a usable period estimating portion configured to estimate a usable period of the relay in accordance with the number of retries.

2. The load driving device according to claim 1, further comprising a conduction current obtaining portion configured to obtain a conduction current flowing through the contact, wherein the usable period estimating portion is configured to estimate the usable period in accordance with the number of retries and the conduction current.

3. The load driving device according to claim 1, further comprising a notice portion configured to notify an operator of the usable period.

4. The load driving device according to claim 3, wherein the notice portion is configured to notify the operator of the usable period when the number of retries is equal to or more than a set number of times.

5. The load driving device according to claim 4, further comprising a conduction current obtaining portion configured to obtain a conduction current at the contact, wherein the notice portion is configured to set the set number of times in accordance with the conduction current.

6. The load driving device according to claim 3, wherein the notice portion is configured to notify the operator of the usable period when the usable period is less than a set period.

7. The load driving device according to claim 1, further comprising, a response time obtaining portion configured to obtain a response time from when the driving control portion outputs the closing command to the driving portion to when the current runs through the contact;

a conduction current obtaining portion configured to obtain a conduction current flowing through the contact; and a conduction current integrating portion configured to integrate the conduction current to calculate a conduction current integrated value, wherein the usable period estimating portion is configured to estimate the usable period in accordance with at least one of the response time, the conduction current, and the conduction current integrated value in addition to the number of retries.

8. The load driving device according to claim 7, further comprising a notice portion configured to notify an operator of the usable period.

9. The load driving device according to claim 8, wherein the notice portion is configured to notify the operator of the usable period when the number of retries is equal to or more than a set number of times, or when the response time is equal to or more than a set time, or when the conduction current integrated value is equal to or more than a set current.

10. The load driving device according to claim 9, wherein the notice portion is configured to set the set number of times, the set time, or the set current in accordance with the conduction current.

11. A load driving method by a load driving device having a relay, wherein the load driving device comprises a driving portion configured to drive the relay so that a contact of the relay enters a closed state or an open state, the load driving method comprising, a driving control step of outputting a closing command for bringing the contact to the closed state to the driving portion, and also outputting to the driving portion alternately the closing command and an opening command for bringing the contact to the open state until current runs through the contact;

a number-of-retries obtaining step of obtaining, as a number of retries, a number of times that the opening command and the closing command were repeated until the current runs through the contact after the closing command has been outputted to the driving portion at the driving control step; and a usable period estimating step of estimating a usable period of the relay in accordance with the number of retries.

12. The load driving method according to claim 11, further comprising a conduction current obtaining step of obtaining a conduction current flowing through the contact, wherein the usable period estimating step estimates the usable period in accordance with the number of retries and the conduction current.

13. The load driving method according to claim 11, wherein the load driving device further comprises a notice portion configured to give an operator notice, and the load driving method further comprises a notice control step of controlling the notice portion to notify the operator of the usable period.

14. The load driving method according to claim 13, wherein the notice control step controls the notice portion to notify the operator of the usable period when the number of retries is equal to or more than a set number of times.

15. The load driving method according to claim 14, further comprising a conduction current obtaining step of obtaining a conduction current at the contact, wherein the notice control step sets the set number of times in accordance with the conduction current.

* * * * *